US006349765B1

(12) United States Patent
Meyers et al.

(10) Patent No.: US 6,349,765 B1
(45) Date of Patent: Feb. 26, 2002

(54) WATER PRESSURE SYSTEM

(75) Inventors: Kenneth A. Meyers, Lena; James A. Meyers, Oconto Falls, both of WI (US)

(73) Assignee: In-Well Technologies, Inc., Lena, WI (US)

( * ) Notice: Subject to any disclaimer, the term of this patent is extended or adjusted under 35 U.S.C. 154(b) by 0 days.

(21) Appl. No.: 09/428,343

(22) Filed: Oct. 27, 1999

(51) Int. Cl.[7] ..... E21B 43/00
(52) U.S. Cl. ..... 166/85.2; 417/44.2
(58) Field of Search ..... 166/85.2, 68, 88.1; 417/38, 44, 53, 44.2

(56) References Cited

U.S. PATENT DOCUMENTS

| | | | | |
|---|---|---|---|---|
| 3,261,296 A | | 7/1966 | Weber | 138/30 |
| 3,394,733 A | | 7/1968 | Jacuzzi | 137/565.34 |
| 3,442,292 A | | 5/1969 | Jacuzzi | 138/30 |
| 3,514,220 A | | 5/1970 | Hahn, Jr. | 417/151 |
| 3,536,102 A | | 10/1970 | Allewitz et al. | 138/30 |
| 3,749,165 A | | 7/1973 | Heaton | 166/75.11 |
| 4,936,383 A | | 6/1990 | Towner et al. | 166/68 |
| 5,281,101 A | * | 1/1994 | Bevington | 417/38 |
| 5,988,984 A | | 11/1999 | Austin | 417/44.2 |

* cited by examiner

*Primary Examiner*—William Neuder
(74) *Attorney, Agent, or Firm*—William K. Baxter; Godfrey & Kahn, S.C.

(57) ABSTRACT

A water pressure system includes a pressure tank installed underground within the well casing of a well. The water pressure system includes a submersible pump connected to the inlet of the pressure tank by a drop pipe. The outlet of the pressure tank is connected to a second drop pipe and in turn to a discharge pipe for distribution of pressurized water to a house or other building. A pressure switch is connected to the pressure tank for controlling the submersible pump. The pressure tank includes an outer sidewall with an inlet end and an outlet end. An expandable diaphragm bladder located within the outer sidewall is connected between the inlet and outlet of the tank. A tube extends through the center of the bladder between an inlet opening and an outlet opening. The tube has a plurality of holes therein to allow water to flow through the tube and into and out of the expandable bladder. Pressurized air fills the empty space between the bladder and the outer sidewall to pressurize the water in the bladder. The pressure tank may be used in combination with a flow control valve or a variable speed pump to maintain the water at a constant pressure.

19 Claims, 9 Drawing Sheets

WATER PRESSURE SYSTEM

BACKGROUND OF THE INVENTION

The present invention relates to water pressure systems for water wells, and more particularly, to a pressure tank installed underground in the well casing of a well, and used in combination with a flow control valve or a variable speed pump in a water pressure system.

A typical water pressure system for a home is established by first drilling a hole in the ground in search of water from a water bearing aquifer. Once water is reached by the drill, a well casing is inserted into the bore hole to preserve the sides of the well. A submersible pump is then inserted into the well below the water level to pump water from the aquifer. One end of a drop pipe is attached to the submersible pump to draw water out of the well. The other end of the drop pipe is attached to a pitless adapter, which is attached to a discharge pipe for carrying water to a pressure tank located in the house or in another building next to the house. Water from the pressure tank is then distributed throughout the house for use.

The pressure tank holds a reserve supply of water under pressure within the tank. A pressure switch coupled to the tank is used to maintain water pressure in tank between a minimum value and a maximum value. The pressure switch activates the submersible pump to pump water into the tank when the water pressure in the tank drops below to the minimum value. Water is then pumped into the tank to replenish the tank with water and to build up the pressure in the tank to its maximum value. Once the pressure in the tank has reached its maximum value, the pressure switch stops the pump from operating. The switch activates the pump generally whenever water is drawn from the tank. The water is stored in the tank under pressure until it's needed. As water is drawn from the tank, the pressure in the tank decreases. Upon reaching the set minimum pressure, the pressure switch automatically activates the pump.

Pressure tanks are normally of substantial size, and consequently are limited to above ground installations in water pressure systems. Typically, pressure tanks are installed in the basement of a house or in a separate building near the house to protect it from the elements. This is especially true in cold climates. Adverse weather conditions can effect the reliability of a pressure tank in cold weather. During the winter months, the pressure tanks must be protected from the cold and snow. Therefore, the tanks are either installed in a basement or in an insulated building above ground.

However, there are problems associated with above ground installations of pressure tanks. A problem with installing a tank in the basement of a building is that the tank may take up valuable space in the home. Also, the installation of the pressure tank can be quite difficult and time-consuming. In addition, the installation of a pressure tank above ground in cold weather climates may require the tank be installed in a separate insulated building. And the tank must often be wrapped in insulation and heat tape.

Water pressure tanks installed underground are known in the art. For example U.S. Pat. No. 3,394,733 to Jacuzzi discloses an airless water pressure system utilizing an underground pressure tank. The pressure tank of this invention includes an expansible tube installed around a pipe having openings therein to transfer liquid from the pipe to the expansible tube. The tube is clamped at each end to allow the liquid under pressure to cause expansion of the tube. However, the clamped ends of the tube have been known to fail under pressure from the liquid. In another patent to Jacuzzi, U.S. Pat. No. 3,442,292 discloses a pressure tank installed underground in a well, having water flowing into the pressure tank around an air filled bladder. The problem with this patented invention is that the air filled bladder seals off water flow from the inlet end of the tank to the outlet end of the tank. In other words, water freely flows into the tank but is sealed off from exiting the tank by the air filled bladder pressing against the walls of the tank.

Accordingly, there is a need for a water pressure system that allows for installation of a pressure tank underground in the well casing of a water well, that is more reliable in cold weather, less expensive to install, and more easily maintained than prior art systems.

SUMMARY OF THE INVENTION

The present invention is a new arrangement for a well pressure tank used in water pressure systems utilizing water wells. In most existing home water pressure systems, the pressure tank is located either in the home or in a separate building near the home. The pressure tank of the present invention is designed to be located in the well casing of a water well. A typical well casing is approximately six inches in diameter. The tank of the present invention is approximately four inches in diameter and approximately ten feet long. The tank has a draw down capacity of approximately 1–3 gallons of water. The pressure tank of the present invention is reduced in size, more reliable in cold weather, less expensive to install, and more easily maintained than prior art pressure tanks.

The water pressure system of the present invention pumps water from a water bearing aquifer to a pressure tank installed underground in the well casing of a well. The water pressure system includes a submersible pump inserted in the well below the water level to pump water from the aquifer. One end of a first drop pipe is attached to the submersible pump, while the other end of the first drop pipe is attached to an inlet opening in a pressure tank installed in the well casing of the well. Water flows from the submersible pump through the drop pipe and into the pressure tank. The water enters the pressure tank through the inlet opening, and is either stored in the tank for future use, or continues to flow out through an outlet opening in the tank. One end of a second drop pipe is connected to the outlet opening in the tank. The other end of the second drop pipe is attached to a pitless adapter which is connected to a discharge pipe for carrying pressurized water to a house or other building for use.

The pressure tank includes a main body having an inlet end, an outlet end, and an outer sidewall. Attached to the inlet end of the tank are an inlet end cap and an inlet plug. The inlet plug is inserted within the inlet end cap. An expandable diaphragm bladder is connected between the inlet plug and the outlet end cap. A tube extends through the center of the expandable diaphragm bladder between an inlet opening and an outlet opening. The tube has a plurality of holes therein to allow water to flow through the tube and into and out of the expandable bladder. The inlet opening of the diaphragm bladder is clamped to a ribbed end of the inlet plug with a clamping device. The outlet opening of the diaphragm bladder is clamped to a ribbed end of the outlet end cap with a similar clamping device. Pressurized air fills the empty space between the bladder and the outer sidewall of the tank to pressurize the water in the expandable bladder.

The outlet end of the drop pipe opposite the end connected to the submersible pump is connected to the inlet plug extending through the inlet end cap of the pressure tank. The other end of the inlet plug is connected to the inlet end of the diaphragm bladder. The outlet end of the diaphragm bladder is attached to the outlet end cap. Water flows through the openings in the inlet end cap, inlet plug, diaphragm bladder, and outlet end cap to a second drop pipe connected to the outlet end cap of the tank. The other end of the second drop pipe is connected to a pitless adapter, which in turn is connected to a discharge pipe for carrying water to the home.

A pressure switch coupled to the pressure tank regulates water pressure in the pressure tank by maintaining the water pressure between a minimum value and a maximum value. The pressure switch continuously monitors the water pressure in the tank, and controls the submersible pump accordingly. The pressure switch responds to a drop in pressure below the minimum value by starting the pump to replenish the water in the tank and to build up the water pressure to its maximum value. The pressure switch stops the pump when the water pressure reaches the maximum value and restarts the pump when the pressure drops below the minimum value.

A first embodiment of the invention includes the well pressure tank used in combination with a flow control valve. The flow control valve automatically adjusts the submersible pump's output to match the flow requirements of the user. The flow control valve maintains constant water pressure in the system. The flow control valve eliminates changes in water pressure and reduces the need for a large storage pressure tank.

A second embodiment of the invention includes the well pressure tank used in combination with a variable speed pump. The variable speed pump performs much the same function as the flow control valve, so that the flow control valve is no longer needed in the water pressure system to maintain constant water pressure. In this embodiment, constant water pressure is maintained by continuously adjusting pump speed to meet water demand. This type of system also minimizes pressure cycling during long-running applications, such as when someone is taking a shower.

Various other features, objects, and advantages of the invention will be made apparent to those skilled in the art from the following drawings and detailed description of the invention.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
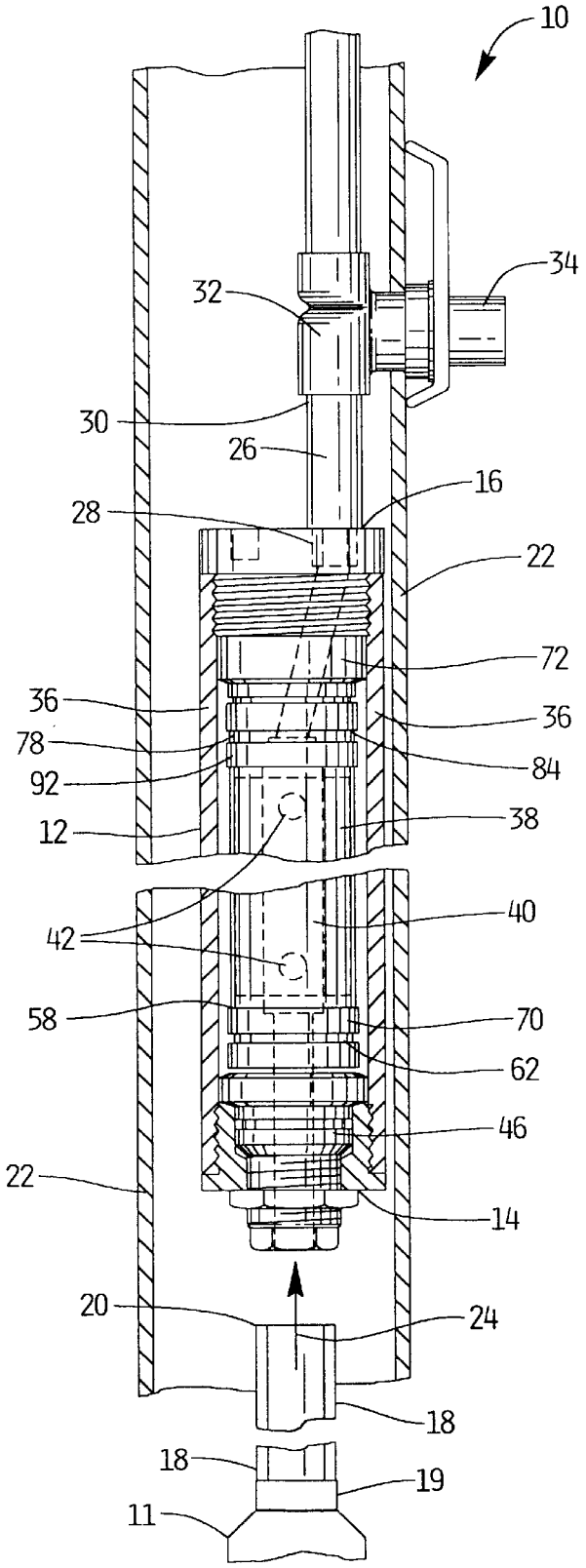
FIG. 1 is a partial cross-sectional side view of a well pressure tank constructed in accordance with the present invention.

FIG. 1 is a partial cross-sectional side view of a water pressure system 10 for a water well constructed in accordance with the present invention. The water pressure system 10 includes a submersible pump 11 installed in the well below the water level to pump water from a water bearing aquifer. A first end 19 of a first drop pipe 18 is attached to the submersible pump 11, while a second end 20 of the first drop pipe 18, opposite the first end 19, is attached to an inlet end 14 of a pressure tank 12 installed in the well casing 22 of a well. The well casing 22 is approximately six inches in diameter, while the pressure tank 12 is approximately four inches in diameter and approximately ten feet long. Water flows from the submersible pump 11 through the first drop pipe 18 and into the inlet end 14 of the pressure tank 12 as shown by arrow 24. The water enters the pressure tank 12 through the inlet end 14, and is either stored in the tank 12 for future use, or continues to flow out through an outlet end 16 in the tank 12.

A first end 28 of a second drop pipe 26 is connected to the outlet end 16 of the pressure tank 12. A second end 30 of the second drop pipe 26, opposite the first end 28, is connected to a pitless adapter 32 which is connected to a discharge pipe 34 for carrying pressurized water to a house or other building for use.

The pressure tank 12 includes an outer sidewall 36 with an inlet end 14 and an outlet end 16. Connected between the inlet end 14 and the outlet end 16 is an expandable diaphragm bladder 38 surrounded by pressurized air for storing a reserve supply of water in the tank 12. A tube 40 extends through the center of the expandable diaphragm bladder 38 from the inlet end 14 to the outlet end 16. The tube 40 includes a plurality of holes 42 extending therethrough to allow water to enter and exit the expandable bladder 38. Water is pumped up through the first drop pipe 18 from the submersible pump 11 and into the inlet end 14 of the pressure tank 12 where it is stored for future use in the expandable diaphragm bladder 38. The water is then pumped out of the bladder 38 through the outlet end 16 of the tank 12 and into a second drop pipe 26 to a pitless adapter 32, where it is transferred to a discharge pipe 34 for distribution and use.

Figure 1A:
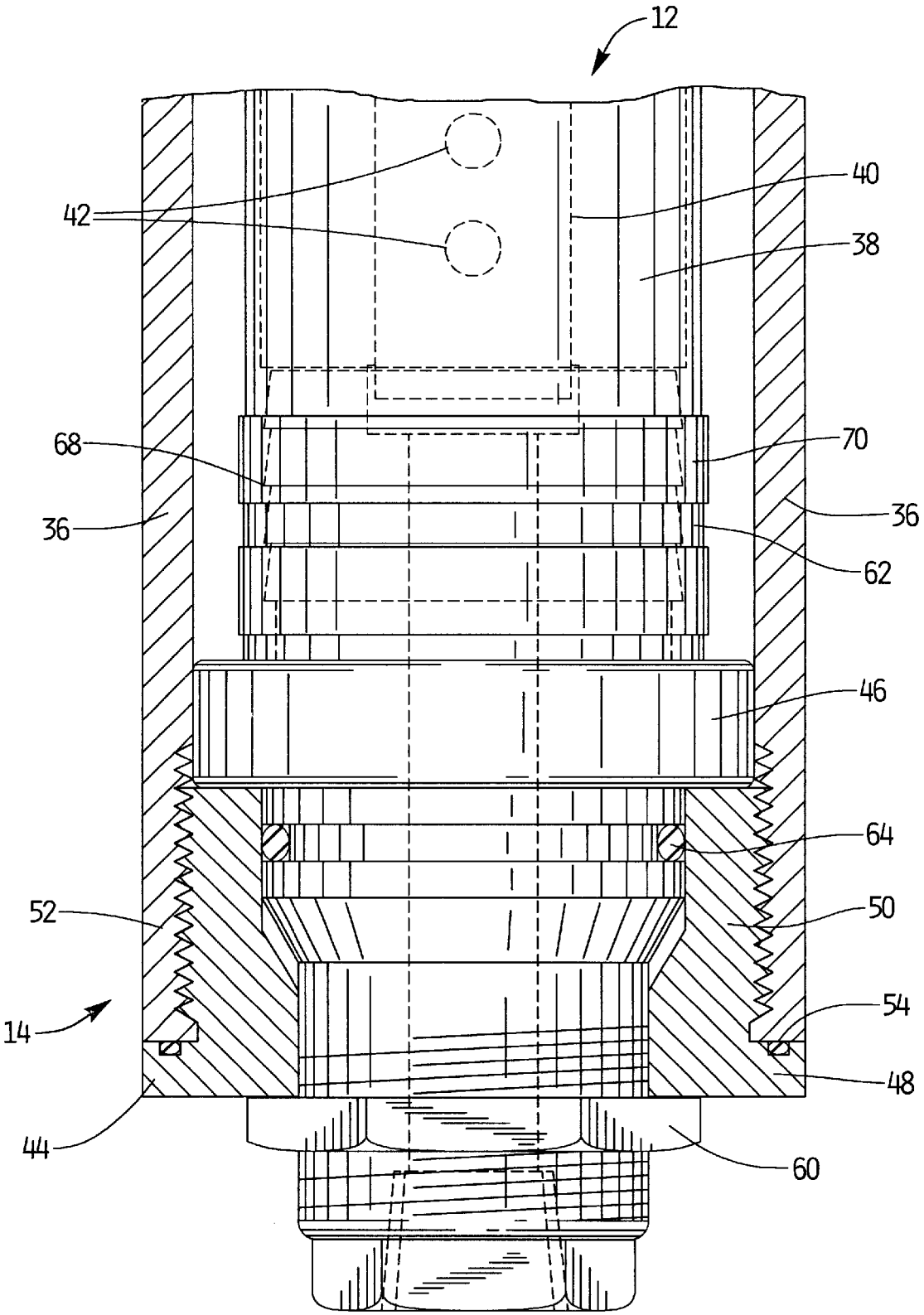
FIG. 1*a* is an enlarged partial cross-sectional view of the inlet end of the well pressure tank of FIG. 1.
Figure 1B:
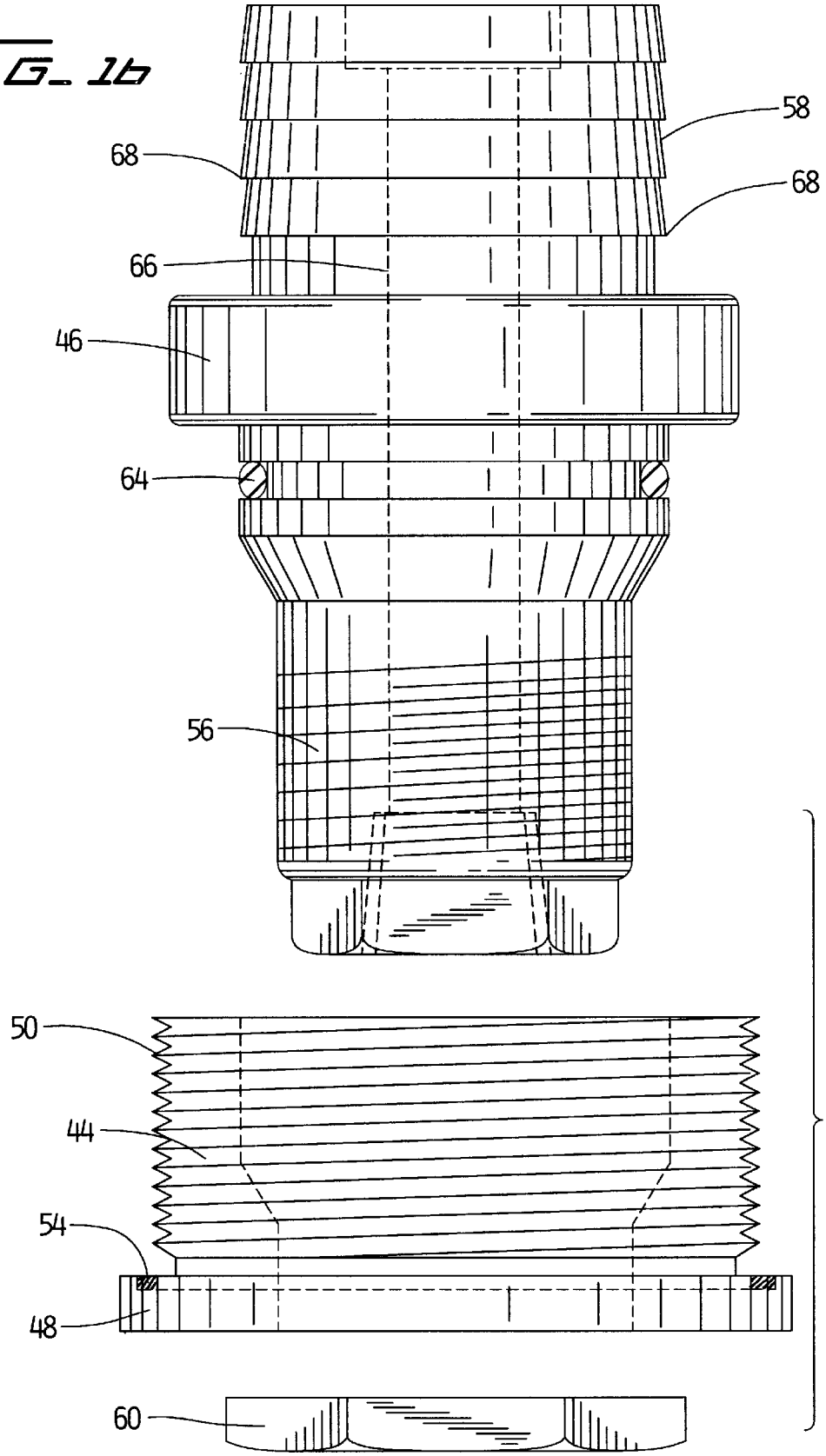
FIG. 1*b* is an enlarged exploded view of the components of the inlet end of the tank of FIG. 1*a;*

FIGS. 1*a* and 1*b* illustrate the inlet end 14 of the tank 12. FIG. 1*a* is an enlarged partial cross-sectional view of the inlet end 14 of the well pressure tank 12, while FIG. 1*b* is an enlarged exploded view of the components that connect the inlet end 14 of the tank 12 to the first drop pipe 18. The inlet end 14 of the tank 12 includes an inlet end cap 44 and an inlet plug 46 extending through the inlet end cap 44. The inlet end cap 44 includes a bottom flange 48 and a cylindrical top portion 50 with standard pipe threads formed therein for attachment to a bottom portion 52 of the sidewall 36 having mating pipe threads formed on the inner surface of the sidewall 36. The inlet end cap 44 is preferably screwed into the inlet end 14 of the tank 12. An o-ring 54 located on an inner portion of the flange 48 seals the end cap 44 to the sidewalls 36 and inlet end 14 of the tank 12.

Inserted within the inlet end cap 44 is an inlet plug 46, having a first end 56 for attachment to the first drop pipe 18 and a second end 58 for attachment to an inlet end 62 of the expandable bladder 38 within the tank 12. The first end 56 having threads for attachment of a fastener 60 to secure the inlet plug 46 in place within the inlet end cap 44. The second end 58 of the plug 46 includes a plurality of ribs 68 for connecting the inlet end 62 of the bladder 38 to the plug 46. A clamping device 70 fits over the ribs 68 of the second end 58 of the plug 46 to secure the inlet end 62 of the bladder 38 to the plug 46. An o-ring 64 located around a center portion of the plug 46 seals the connection between the plug 46 and the end cap 44. An opening 66 extending through the inlet plug 46 allows water to flow through the plug 46 to the tube 40 within the bladder 38.

Figure 1C:
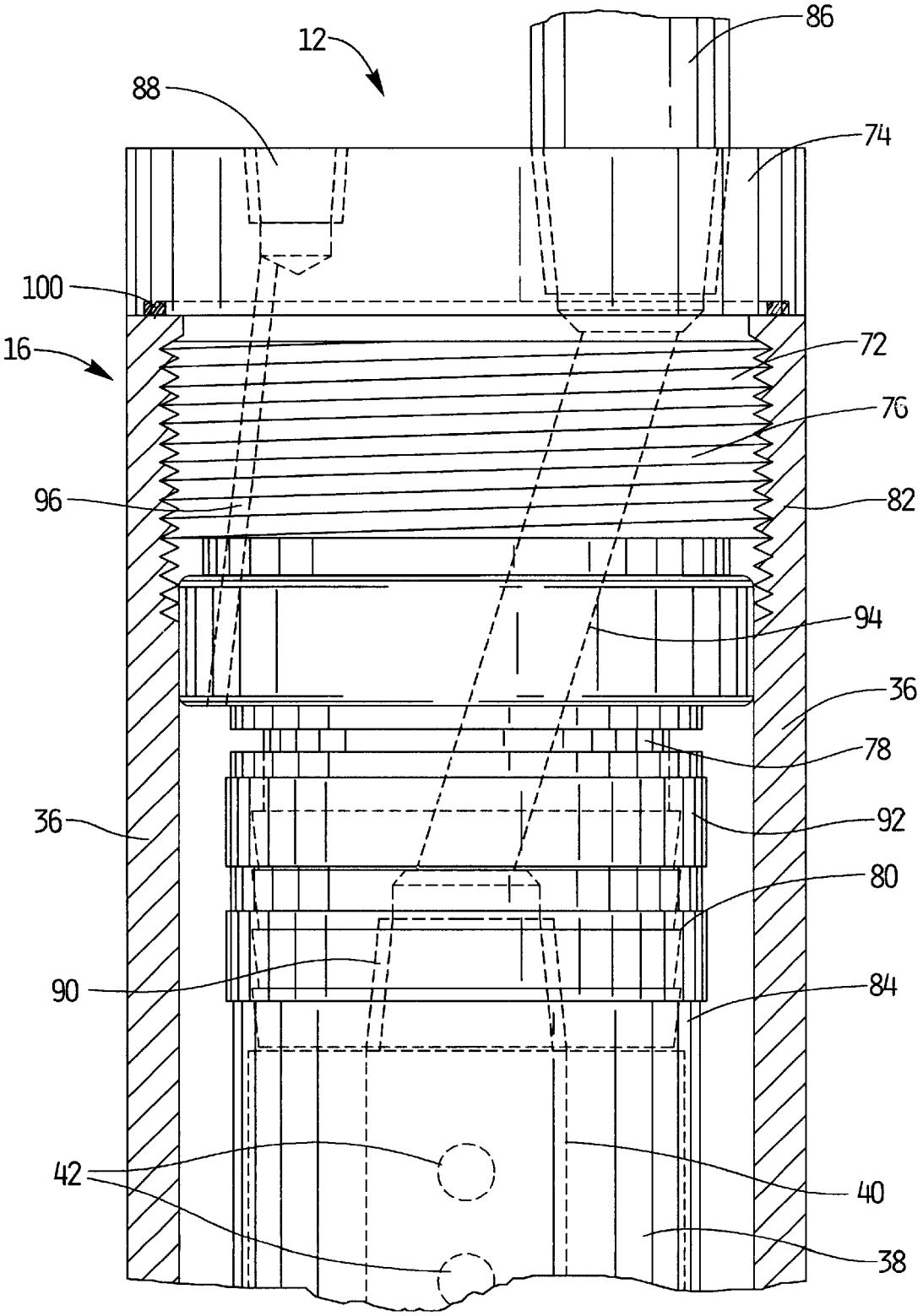
FIG. 1*c* is an enlarged partial cross-sectional view of the outlet end of the well pressure tank of FIG. 1.
Figure 1D:
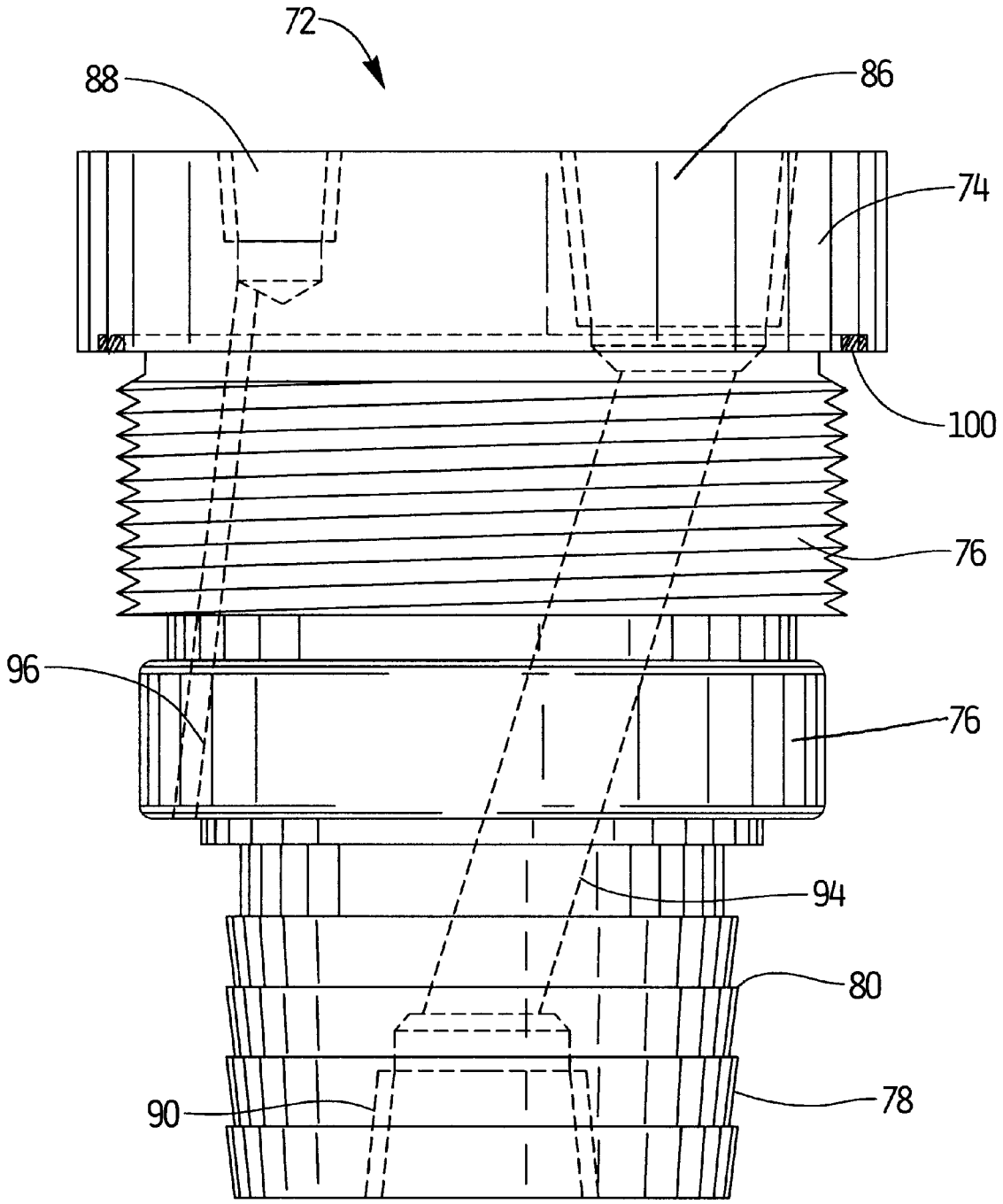
FIG. 1*d* is an enlarged view of an outlet end cap of the tank of FIG. 1*c;*

FIGS. 1*c* and 1*d* illustrate the outlet end 16 of the tank 12. FIG. 1*c* is an enlarged partial cross-sectional view of the outlet end 16 of the tank 12, while FIG. 1*d* is an enlarged view of an outlet end cap 72 that connects the outlet end 16 of the tank 12 to the second drop pipe 26. The outlet end cap 72 includes a top flange 74 for enclosing the outlet end 16 of the tank 12, a center portion 76 for securing the outlet end cap 72 to the outer sidewall 36, and a bottom portion 78 for connecting the outlet end cap 72 to an outlet end 84 of the bladder 38. The center portion 76 having threads embedded therein for mating with threads on the inner surface of a top portion 82 of the outer sidewall 36. The bottom portion 78 having ribs 80 for securing the outlet end 84 of the bladder 38 to the outlet end cap 72. A clamping device 92 fits over the ribs 80 of the bottom portion 78 to secure the outlet end 84 of the bladder 38 to the outlet end cap 72.

The top flange 74 has connections 86, 88 for connecting the outlet end 16 of the tank 12 to the second drop pipe 26 and a pressure switch 98. The bottom portion 78 of the outlet end cap 72 has a connection 90 for connecting to the tube 40 within the bladder 38. A first opening 94 extending through the outlet end cap 72 between the tube connection 90 and the second drop pipe connection 86 allows water to flow from the tube 40 within the bladder 38 through the outlet end cap 72 to the second drop pipe 26. A second opening 96 extending through the flange 74 and the center portion 76 of the outlet end cap 72 allows pressurized air to flow from the pressure tank 12 to the pressure switch 98. An o-ring 100 located on an inner portion of the top flange 74 seals the outlet end cap 72 to the sidewall 36 of the outlet end 16 of the tank 12.

Referring again to FIG. 1, the expandable diaphragm bladder 38 is connected between the inlet plug 46 and the outlet end cap 72. The inlet end 62 of the bladder 38 is clamped to ribs 68 on the second end 58 of the inlet plug 46 with a clamping device 70. The outlet end 84 of the bladder 38 is clamped to ribs 80 on the bottom portion 78 of the outlet end cap 72 with a similar clamping device 92. The tube 40 extends through the center of the expandable diaphragm bladder 38 between the inlet end 62 and the outlet 84. The tube 40 has a plurality of holes 42 therein to allow water to flow into and out of the expandable bladder 38. Pressurized air fills the empty space between the bladder 38 and the outer sidewall 36 of the tank 12 to pressurize the water. The components of the pressure tank 12 are preferably made out of a non-corrosive sanitary material, such as plastic or PVC to eliminate corrosion and bacterial growth. The expandable diaphragm bladder 38 is preferably made out of butyl rubber.

Figure 2A:
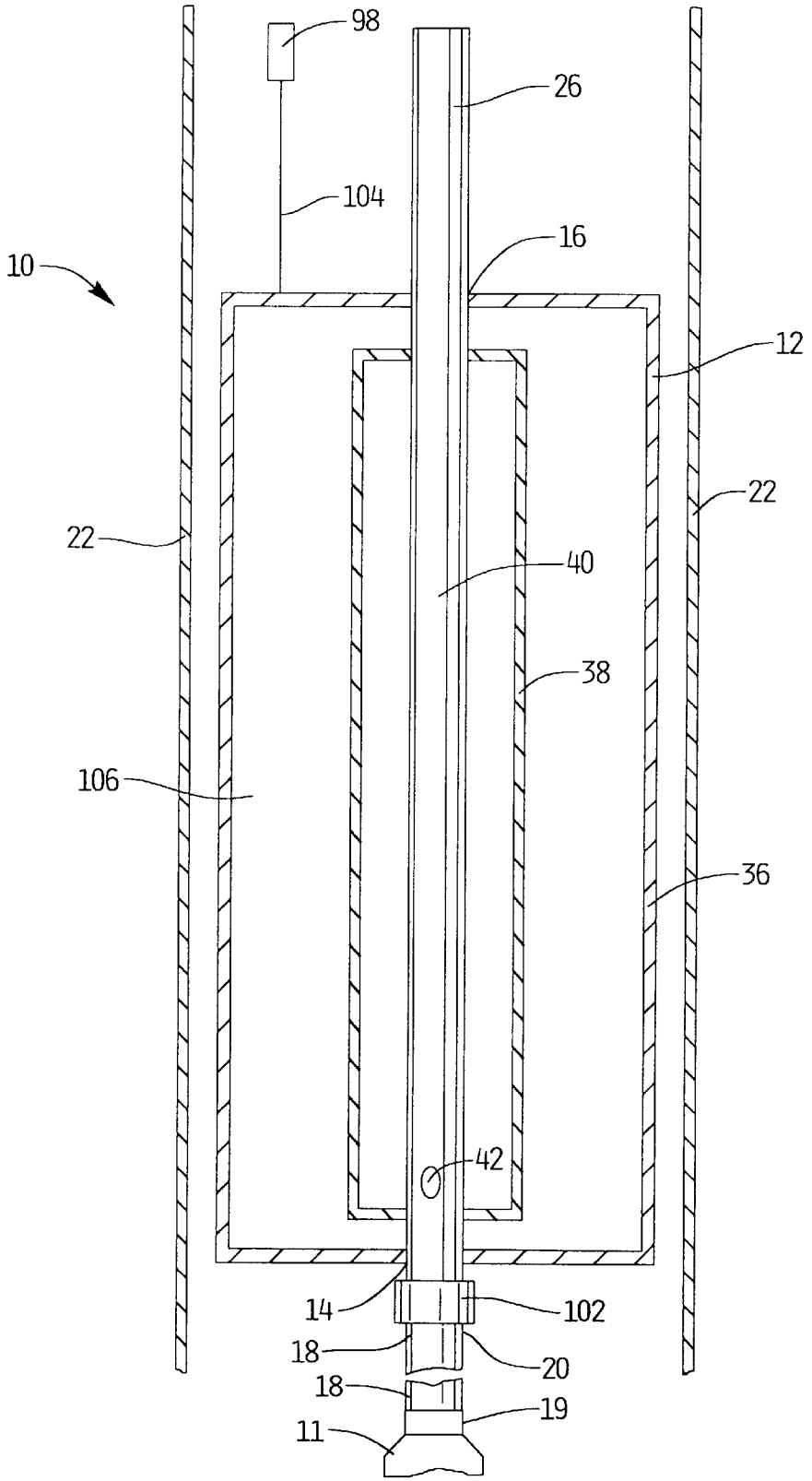
FIG. 2*a* is a partial cross-sectional schematic view of a first embodiment of a well pressure tank used in combination with a flow control valve to maintain constant water pressure in the system.
Figure 2B:
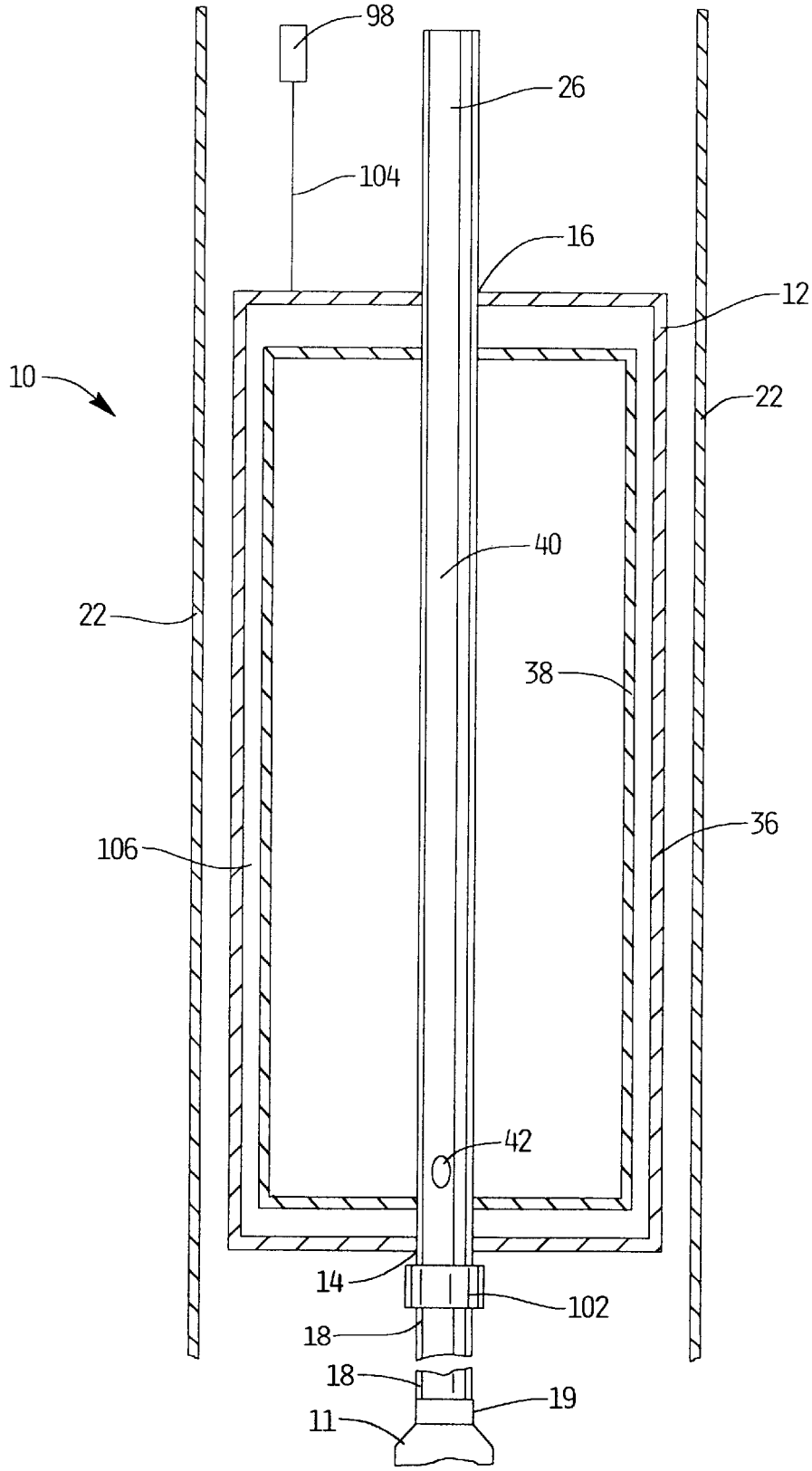
FIG. 2*b* is a partial cross-sectional schematic view of the well pressure tank of FIG. 2*a* filled with water.

FIGS. 2*a* and 2*b* illustrate the operation of a first embodiment of the present invention. FIG. 2*a* shows a pressure tank 12 installed in the well casing 22 of a well. The pressure tank 12 is used in combination with a pressure switch 98 and a flow control valve 102. One end of a first drop pipe 18 is connected to a submersible pump 11, while the other end is connected to a flow control valve 102. The flow control valve 102 is connected to the inlet end 14 of the pressure tank 12. The pressure tank is comprised of an inlet end 14, an outlet end 16, and an outer sidewall 36. Within the outer sidewall 36 of the tank 12 is an expandable diaphragm bladder 38 surrounded by an open area pre-charged with pressurized air 106. The open area 106 in the tank surrounding the bladder 38 is pre-charged with air to a pre-set amount depending on the desired operating pressure. A pressure switch 98 is coupled to the tank 12 with an air line 104 to monitor the pressure within the tank 12 and to control operation of the pump 11 accordingly. There is an air line 104 running from the pressure switch 98 to the tank 12. The flow control valve 102 maintains the flow of water through the system at a constant pressure. Openings 42 in a center tube 40 within the bladder 38 allow water to flow into and out of the bladder as pressure in the tank 12 varies. As water demand increases, pressure in the tank decreases.

The pressure switch 98 coupled to the pressure tank 12 regulates water pressure in the tank 12 by maintaining the water pressure between a minimum value and a maximum value. The pressure switch 98 continuously monitors the pressure in the tank 12, and controls the submersible pump 11 accordingly. The pressure switch 98 responds to a drop in pressure below the minimum value by starting the pump 11 to replenish the water in the tank 12 and to build up the water pressure to its maximum value. The pressure switch 98 stops the pump 11 when the water pressure reaches the maximum value and restarts the pump 11 when the pressure drops below the minimum value. FIG. 2*a* shows the tank 12 with little or no water in the expandable diaphragm bladder 38. FIG. 2*b* shows the expandable bladder 38 of FIG. 2*a* virtually filled with water.

Figure 3A:
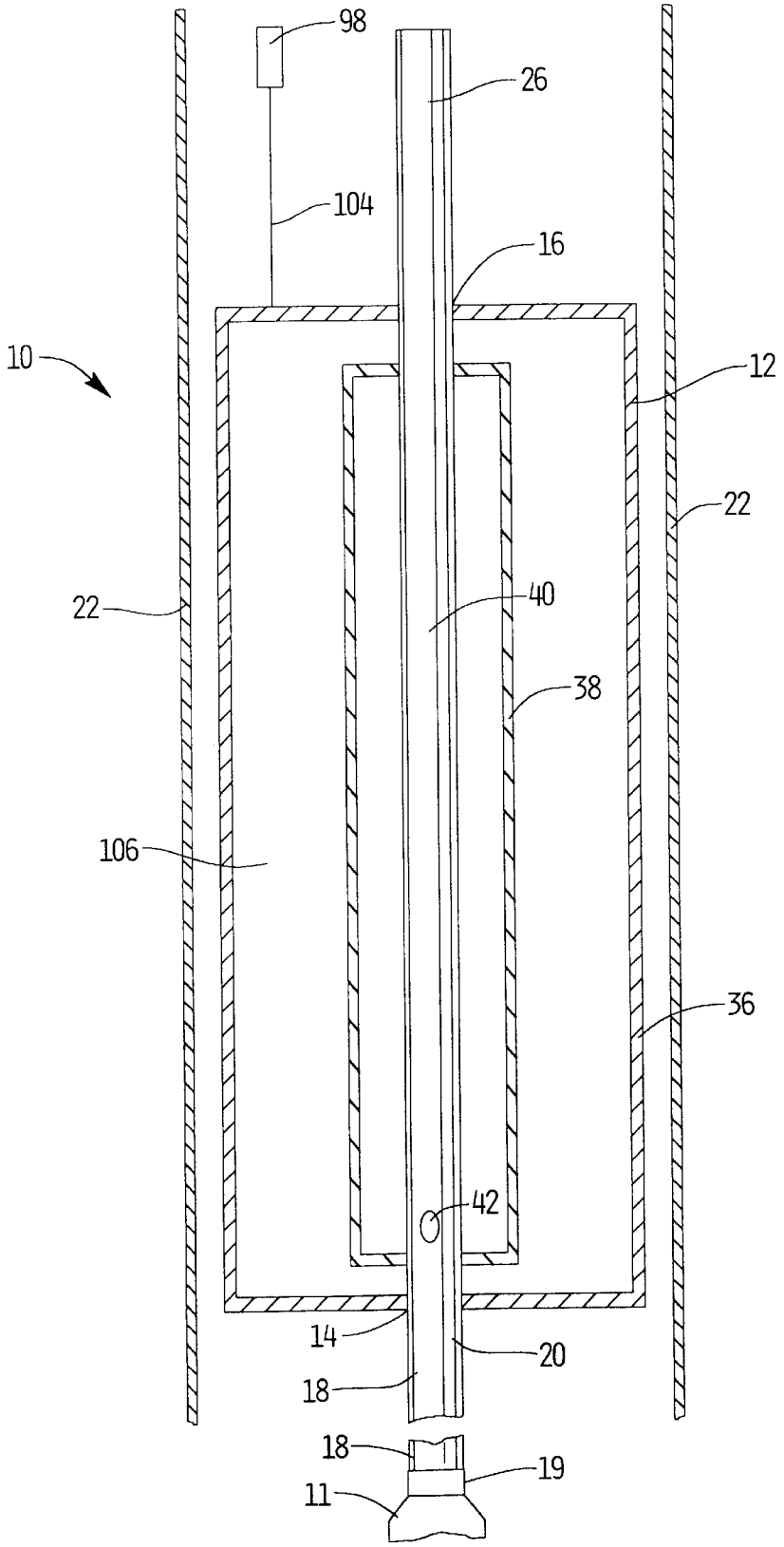
FIG. 3*a* is a partial cross-sectional schematic view of a second embodiment of a well pressure tank used in combination with a variable speed pump.
Figure 3B:
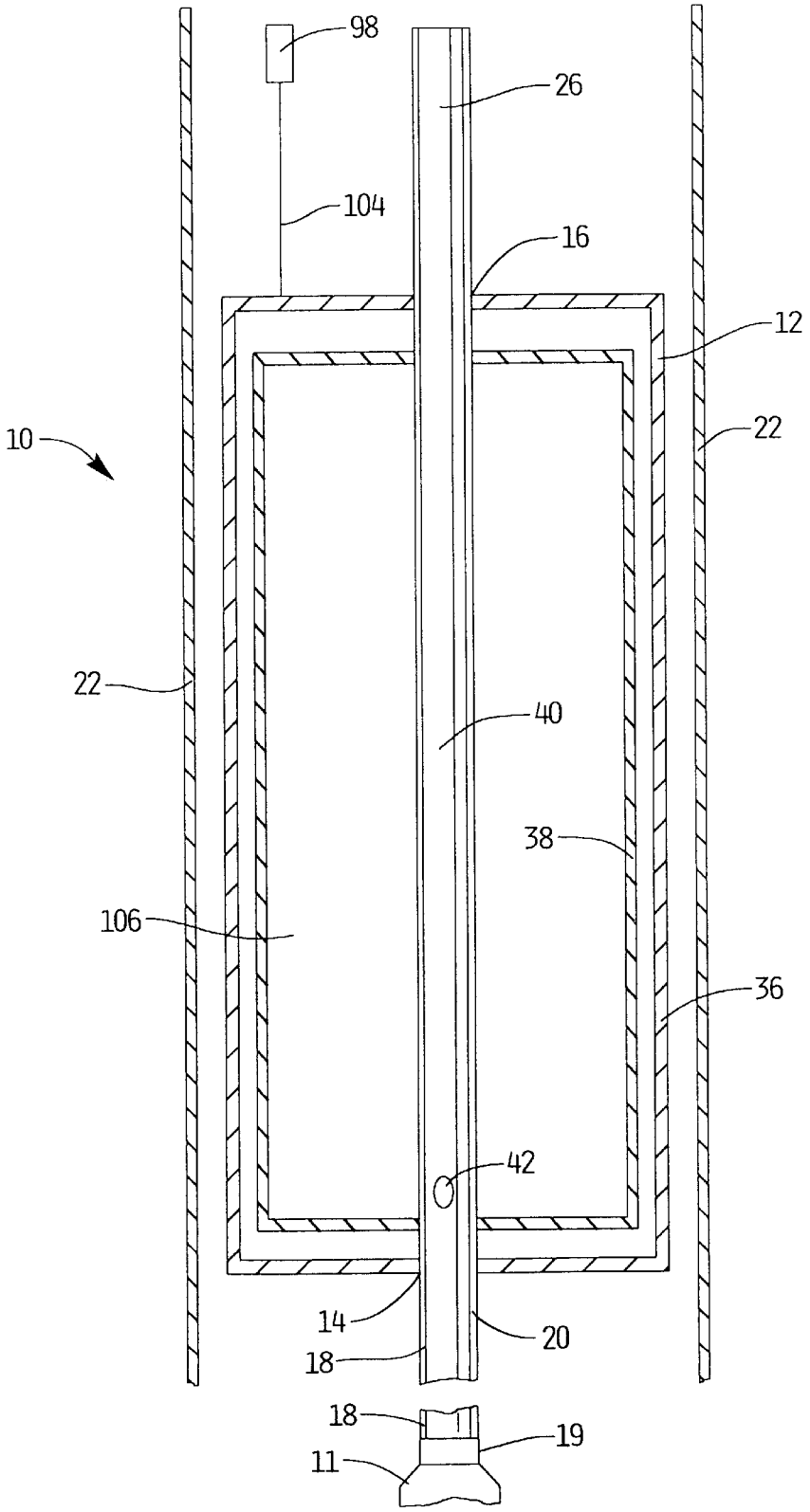
FIG. 3*b* is a partial cross-sectional schematic view of the well pressure tank of FIG. 3*a* filled with water.

FIGS. 3*a* and 3*b* illustrate the operation of another embodiment of the present invention. FIG. 3*a* is a schematic view of a second embodiment of a water pressure system with a pressure tank 12 installed in the well casing 22 of a well, and utilizing a variable speed pump 11 to maintain constant water pressure in the system. This embodiment does not include the use of a flow control valve. Constant water pressure is maintained by continuously adjusting pump speed to meet water demand. A pressure switch 98 coupled to the pressure tank 12 controls the speed of the variable speed pump 11. This type of system also minimizes pressure cycling during long-running applications. Water enters the pressure tank 12 through an inlet end 14, and is either stored in the tank 12 for future use, or continues to flow through the tank 12 and out its outlet end 16. The water flows through a tube 40 in the tank 12 and into the expandable bladder 38 which is surrounded by pressurized air in the tank. The water filled bladder 38 stretches or contracts as the water pressure varies. The pressure switch 98 monitors the pressure in the tank and adjusts the speed of the pump 11 accordingly. FIG. 3*a* shows the bladder 38 with little or no water inside it, while FIG. 3*b* shows the bladder 38 virtually filled with water.

While the invention has been described with reference to preferred embodiments, those skilled in the art will appreciate that certain substitutions, alterations and omissions may be made without departing from the spirit of the invention. Accordingly, the foregoing description is meant to be exemplary only, and should not limit the scope of the invention set forth in the following claims.

We claim:

1. A water pressure system comprising:

a submersible pump for pumping water from a water bearing aquifer;

a pressure tank installed in a well casing of the water pressure system, and connected to the submersible pump with a drop pipe, the pressure tank including an inlet end, an outlet end, and an outer sidewall with an expandable diaphragm bladder located within the outer sidewall of the tank that is fillable with water from the submersible pump for storing a reserve of water; and a pressure switch coupled to an open area of the pressure tank between the outer sidewall of the tank and the expandable bladder that is pre-charged with pressurized air, the pressure switch coupled to the open area of the pressure tank with an air line for monitoring pressure in the tank and controlling operation of the submersible pump.

2. The water pressure system of claim 1 wherein the pressure tank is small enough to fit underground within the well casing of a water well.

3. The water pressure system of claim 2 wherein the pressure tank is approximately four inches in diameter and approximately ten feet long.

4. The water pressure system of claim 1 wherein the pressure tank can draw down approximately one to three gallons of water.

5. The water pressure system of claim 1 wherein the expandable diaphragm bladder is made of butyl rubber.

6. The water pressure system of claim 1 wherein the pressure tank is made of a non-corrosive sanitary material, such as plastic.

7. The water pressure system of claim 1 wherein the pressure tank is made of PVC.

8. The water pressure system of claim 1 further comprising a flow control valve connected between the submersible pump and the pressure tank for maintaining constant water pressure in the system.

9. The water system of claim 1 wherein the submersible pump is a variable speed pump for maintaining constant water pressure in the system.

10. A water pressure system for use with underground water wells comprising:

a submersible pump installed in an underground well of a water pressure system;

a first drop pipe having a first end and a second end opposite the first end, the first end connected to the submersible pump for pumping water from a water bearing aquifer;

a flow control valve connected to the second end of the first drop pipe to maintain the flow of water in the system at a constant pressure;

a pressure tank installed in a well casing of the water pressure system, and connected to the second end of the first drop pipe, the pressure tank including an inlet end connected to the flow control valve, an outlet end, and an outer sidewall with an expandable diaphragm bladder located within the outer sidewall of the tank that is fillable with water from the submersible pump for storing a reserve of water;

a second drop pipe having a first end and a second end opposite the first end, with the first end connected to the outlet end of the pressure tank;

a pitless adapter having an inlet connected to the second end of the second drop pipe, and an outlet connected to a discharge pipe; and a pressure switch coupled to an open area of the pressure tank between the outer sidewall of the tank and the expandable bladder that is pre-charged with pressurized air for monitoring pressure in the tank and controlling operation of the submersible pump.

11. The water pressure system of claim 10 wherein the pressure tank is small enough to fit in the well casing of a water well.

12. The water pressure system of claim 11 wherein the pressure tank is approximately four inches in diameter and approximately ten feet long.

13. The water pressure system of claim 10 wherein the pressure tank can draw down approximately one to three gallons of water.

14. The water pressure system of claim 10 wherein the expandable bladder is made of butyl rubber.

15. The water pressure system of claim 10 wherein the pressure tank is made of a non-corrosive sanitary material.

16. The water pressure system of claim 15 wherein the pressure tank is made of PVC.

17. A water pressure system comprising:

a variable speed submersible pump installed in a water well;

a pressure tank installed in a well casing of the water pressure system, and connected to the variable speed submersible pump with a drop pipe, the pressure tank including an inlet end, an outlet end, and an outer sidewall with an expandable diaphragm bladder located within the outer sidewall of the tank that is fillable with water from the submersible pump for storing a reserve of water, and a pressure switch coupled to an open area of the pressure tank between the outer sidewall of the tank and the expandable bladder that is pre-charged with pressurized air, the pressure switch coupled to the open area of the pressure tank with an air line for monitoring pressure in the tank and controlling the speed of the variable speed submersible pump.

18. The water pressure system of claim 17 wherein the pressure tank is small enough to fit in the well casing of a water well.

19. The water pressure system of claim 18 wherein the pressure tank is approximately four inches in diameter and approximately ten feet long.

* * * * *